United States Patent [19]

Newman et al.

[11] 4,422,136

[45] Dec. 20, 1983

[54] SHOCK MOUNTING DEVICE FOR A LAMP

[75] Inventors: Charles J. Newman; Joseph T. Hodges, both of Madison, Ind.

[73] Assignee: The Grote Manufacturing Company, Inc., Madison, Ind.

[21] Appl. No.: 361,587

[22] Filed: Mar. 25, 1982

[51] Int. Cl.[3] ..... F21V 15/04

[52] U.S. Cl. ..... 362/390; 362/61; 362/83; 362/306; 362/369; 362/376; 362/377; 362/396

[58] Field of Search ..... 362/390, 61, 83, 306, 362/369, 376, 377, 396

[56] References Cited

U.S. PATENT DOCUMENTS

| | | | |
|---|---|---|---|
| Re. 30,498 | 1/1981 | Baldwin | 362/396 |
| 2,051,324 | 8/1936 | Williamson | 362/369 |
| 3,467,822 | 9/1969 | Plume | 362/390 |
| 4,056,718 | 11/1977 | Faux et al. | 362/306 |
| 4,241,371 | 12/1980 | Sage | 362/276 |
| 4,282,566 | 8/1981 | Newman | 362/390 |

*Primary Examiner*—Stephen J. Lechert, Jr.
*Attorney, Agent, or Firm*—Harry B. O'Donnell, III

[57] ABSTRACT

This invention provides a novel device for shock mounting a lamp within housing means for a lamp that is particularly intended for use with motorized vehicles, such as farm tractors and other vehicles designed for cross-country travel, as well as over-the-road trucks and the like. Basically, the novel device of the present invention comprises a hollow generally frustoconical resilient member having a long-central axis extending between centers of its opposite ends, with one of the opposite ends of that member including means for retaining, supporting and locating a lamp in a predetermined position, and the other of the opposite ends of that member including means for fastening that member to the lamp housing means, and that member including plural segments positioned around the long-central axis and extending between the opposite ends of that member, with each of the plural segments being generally serpentine in its longitudinal extension with respect to that axis. Preferably, the means for retaining, supporting and locating comprise seat means formed on the resilient member adjacent the intersection of one end of each of the plural segments with a portion of a circumferential flange that is formed on and extends around the first-mentioned one of the opposite ends of that member and the means for fastening include plural apertures provided in the other of the opposite ends of that member.

8 Claims, 5 Drawing Figures

FIG. 1
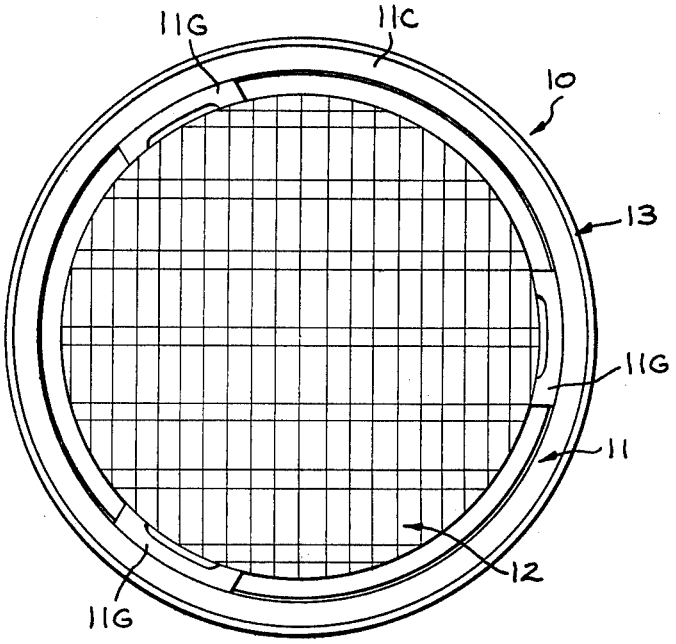
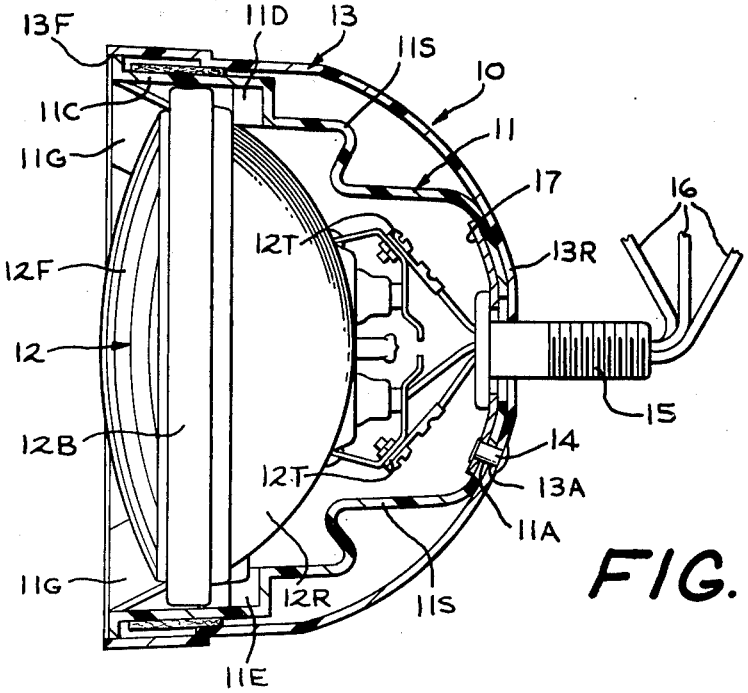
FIG. 2

SHOCK MOUNTING DEVICE FOR A LAMP

BACKGROUND OF THE INVENTION

This invention relates to lamps and, more particularly, to a novel and useful device for shock mounting a lamp within housing means for a lamp that is particularly intended for use with motorized vehicles, such as farm tractors and other vehicles designed for cross-country travel, as well as over-the-road trucks and the like.

Many lamps are used on motor vehicles and are, as a result, subject to frequent vibrations and mechanical shocks. Unless the incandescent filaments of such lamps are protected from such vibrations and shocks, they may fail quite rapidly.

In the past, several forms of prior-art devices have been provided for "shock mounting" a lamp within housing means for a lamp. Typical forms of such prior-art lamp, "shock mounting" devices are shown and described in detail in U.S. Pat. Nos. 2,800,578 (Falge); 2,910,577 (Bolmeyer); 3,025,390 (Woodcock); 3,050,621 (Spencer); 3,067,326 (Knapp); and 3,375,367 (Woodcock).

All six of the aforenoted forms of prior-art lamp "shock mounting" devices provide resilient means for mounting a so-called "sealed beam" lamp to a generally cup-shaped lamp housing that is, in turn, rigidly fastened to a motor vehicle. On the other hand, U.S. Pat. No. 3,225,189 (Pendell) shows a different prior-art form of lamp "shock mounting" device wherein the so-called "sealed beam" lamp is mounted in generally cup-shaped resilient member that is, in turn, directly fastened to the motor vehicle.

While the just-noted Pendell form of prior-art lamp "shock mounting" device may offer the advantages of superior vibration and shock isolation for the lamp claimed by its patentee over the previously-noted prior-art forms, its resilient generally cup-shaped member is not mounted within and not even partially covered by any protective lamp housing means and is thus exposed to attack from the atmosphere and, hence, tends to physically deteriorate more rapidly than those other prior-art forms.

The present invention is, among other things, concerned with providing a novel lamp "shock mounting" device which provides superior vibration and shock isolation for the lamp to that available with the first-mentioned prior-art forms of such devices, while also avoiding the just-noted disadvantage of the prior-art form of Pendell.

SUMMARY OF THE INVENTION

The present invention provides a novel device for shock mounting a lamp within housing for a lamp that is particularly intended for use with motorized vehicles, such as farm tractors and other vehicles designed for cross-country travel, as well as over-the-road trucks and the like.

Basically, the novel device of the present invention comprises a hollow generally frustoconical resilient member having a long-central axis extending between centers of its opposite ends, with one of the opposite ends of that member including means for retaining, supporting and locating a lamp in a predetermined position, and the other of the opposite ends of that member including means for fastening that member to the lamp housing means, and that member including plural segments positioned around the long-central axis and extending between the opposite ends of that member, with each of the plural segments being generally serpentine in its longitudinal extension with respect to that axis.

Preferably, the means for retaining, supporting and locating comprise seat means formed on the resilient member adjacent the intersection of one end of each of the plural segments with a portion of a circumferential flange that is formed on and extends around the first-mentioned one of the opposite ends of that member and the means for fastening include plural apertures provided in the other of the opposite ends of that member.

BRIEF DESCRIPTION OF THE DRAWINGS

The present invention is illustrated in the accompanying drawings, wherein:

FIG. 1 is a front elevational view illustrating a vehicle head lamp assembly employing a presently-preferred form of the novel device for "shock mounting" a lamp that is provided in accordance with the present invention;

FIG. 2 is a vertical sectional view through the vehicle head lamp assembly of FIG. 1, with the associated "sealed beam" lamp shown in vertical elevation;

DETAILED DESCRIPTION

Figure 3:
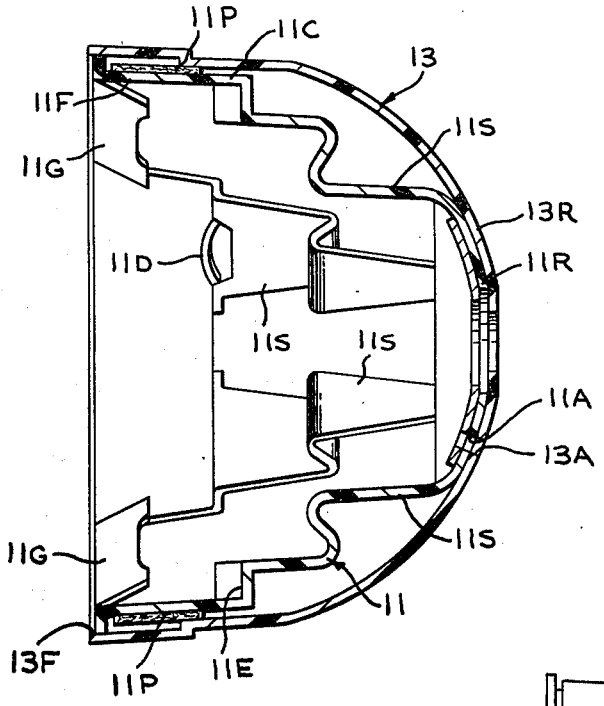
FIG. 3 is a view similar to FIG. 2, but with the "sealed beam" lamp unit and its associated parts removed.

Turning now to the drawings, there is illustrated a vehicle head lamp assembly 10 that is particularly intended for use with motorized vehicles (not shown), such as farm tractors and other vehicles designed for cross-country travel, as well as over-the-road trucks and the like. As shown, the lamp assembly 10 employs a presently-preferred form of a novel device 11 that is provided in accordance with the present invention for shock mounting an incandescent lamp, such as the so-called "sealed beam" lamp unit 12 which is illustrated in FIGS. 1 and 2, within housing means 13 for such a lamp as shown in FIGS. 1–3.

The illustrated sealed beam lamp unit 12 is conventional and can be readily obtained from General Electric Company, Westinghouse Electric Company or other lamp suppliers. As best shown in FIG. 2, the incandescent lamp unit 12 has, between its front 12F and rear 12R surfaces, a peripheral bead 12B that extends around its circumference and includes means, which will be described in detail hereinafter, that are engageable with complementary means that are provided on the novel shock mounting device or member 11 of the present invention for retaining, supporting and locating the lamp unit 12 within the lamp housing 13 in a predetermined position.

As shown in FIGS. 1–3, the lamp housing means 13 comprises a generally cup-shaped member that has an open front end 13F and a domed opposite rear end 13R, with the lamp unit 12 being mounted wholly within the lamp housing member 13 by the novel shock mounting device or member 11 that is provided in accordance with the present invention.

Basically, the novel shock mounting device 11 of the present invention comprises a hollow, generally frustoconical resilient member 11 having a long-central axis extending between centers of its opposite open front 11F and domed rear 11R ends. The domed rear end 11R of the shock mounting device or member 11 is complementary in shape to the domed rear end 13R of the lamp housing means 13 and is fastened to the interior thereof and cantilevered therefrom by fastener means, such as rivets 14 illustrated in FIG. 2 which are passed through a plurality of aligned apertures 11A and 13A that are provided in the domed rear ends 11R and 13R of the shock mounting device 11 and the lamp housing 13, with the aforedescribed long-central axis of the shock mounting device 11 being concentrically placed with respect to that of the lamp housing member 13.

Figure 4:
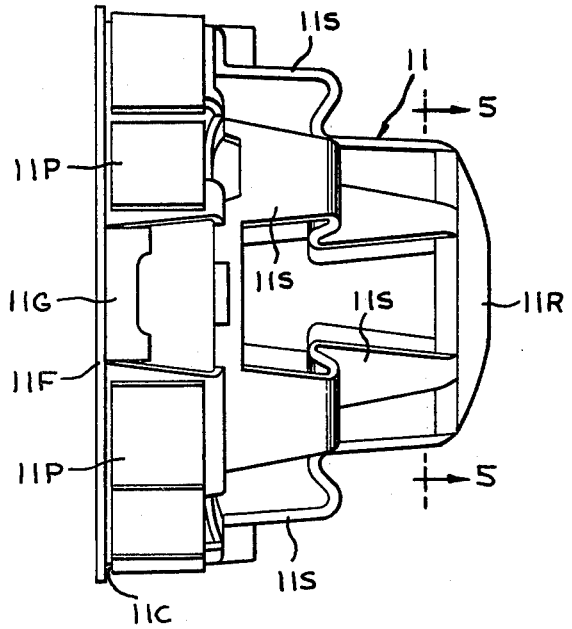
FIG. 4 is a side elevational view of the form of the novel device for "shock mounting" a lamp that is provided in accordance with the present invention and illustrated in FIGS. 1–3, as it appears prior to its association with the "sealed beam" head lamp unit and the housing therefor.

The other opposite or open front end 11F of the novel shock mounting device or member 11 of the present invention has a circumferential flange 11C that extends around it and includes means for retaining, supporting and locating the lamp unit 12 in a predetermined position and in particular accordance with the present invention and as best shown in FIGS. 3 and 4, includes plural segments 11S positioned around its aforenoted long-central axis and extending between its aforenoted opposite ends 11F and 11R, with each of those plural segments 11S being generally serpentine in its longitudinal extension with respect to that axis. And, preferably, as best shown in FIGS. 2 and 3, the aforenoted means for retaining, supporting and locating of the lamp unit 12 within the lamp housing 13 include seat means 11D and 11E formed on the resilient shock mounting device or member 11 adjacent the intersection of one end—the front end—of each of its plural segments 11S with a first or rear portion of its circumferential flange 11C that is formed on and extends around its front end 11F, as well as plural finger-like grips 11G formed on a second or front portion of that same circumferential flange 11C.

While various materials and methods may be employed for constructing the shock mounting device or member 11 of the present invention, good results have been obtained by molding the same of either a resilient plastic material, such as nylon, or a resilient elastomeric material or compound, which have good shock and vibration absorbing characteristics. Particularly good results have been obtained by molding the same of DuPont's "Zytel" nylon. And, the lamp housing 13 can be constructed of various materials, including plastics and metals, it being understood, of course, that, preferably, said lamp housing 13 should be relatively rigid when compared to the novel, hollow, generally frustoconical resilient shock mounting device or member 11 of the present invention and that the device 11 and the lamp housing 13 should be dimensioned such that the device 11 and the lamp unit 12 can be mounted wholly within the lamp housing 13, as shown in FIGS. 1 and 2 of the drawings.

As further shown in the drawings, each of the flexible, serpentine segments 11S is wedge-shaped in transverse cross-section, with the smaller end of the wedge being connected to the smaller or domed rear end 11R of the generally frustoconical shock mounting device or member 11 that is cantilevered from and connected to the domed rear end 13R of the lamp housing means 13, and with the larger end of the wedge being connected to the rear portion of the circumferential flange 11C that surrounds the larger or open front end 11F of said device or member 11 and is provided with the means for retaining, supporting and locating 11D, 11E and 11G the lamp unit 12 wholly within the open front end 13F of the lamp housing 13 in a predetermined position.

With the foregoing arrangement, shock and vibration loads are dampened both along and around the long axes of each of the plural serpentine segments 11S of the novel shock mounting device 11 of the present invention. And, as further shown in drawing FIGS. 2–4, it is also desirable that gasket means, such as the illustrated plastic foam pads 11P, be provided on the exterior of an axially extending third portion of the aforenoted circumferential flange 11C for dampening transmission of any mechanical shocks or vibrations between that portion of the novel shock mounting device 11 and the complementary interior wall of the adjacent open front end 13F of the lamp housing 13. These gasket means or pads 11P also serve to provide a partial seal between the front ends 11F and 13F of the shock mounting device 11 and the lamp housing 13 and thus inhibit undesired entry of atmospheric moisture and the like into the area within the lamp housing 13 and the novel shock mounting device 11 and, hence, prolong the useful life of said device 11.

Figure 5:
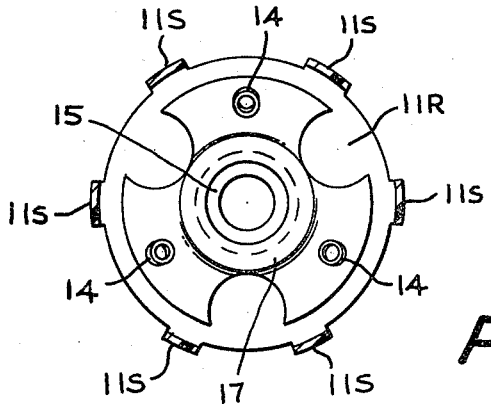
FIG. 5 is a sectional view taken along line 5—5 of FIG. 4.

Preferably, the novel shock mounting device or member 11 of the present invention is first connected to the lamp housing 13 by aligning the plural apertures 11A and 13A which are respectively provided in the domed ends 11R and 13R of each over one another and fastening the same together with the rivets 14 which are passed therethrough. And, as best shown in FIGS. 2, 3 and 5 of the drawings, it is desirable that those same rivets 14 be used to connect a threaded conduit or nipple 15 to both the shock mounting device 11 and the lamp housing 13 through which electrical wires 16 can be passed for connection to electrical terminals 12T that are provided on the rear face 12R of the lamp unit 12 and by which the thus joined shock mounting device 11 and lamp housing 13 can be further mechanically and electrically connected to the vehicle (not shown). As further shown in FIG. 5, it is also desirable that the threaded conduit or nipple 15 be secured to a reinforcing bracket 17 that is complementary in shape to the interior of the domed rear end of the device 11 and is provided with plural apertures that can be aligned with the aforenoted apertures 11A and 13A which are respectively provided in the domed ends 11R and 13R of the shock mounting device 11 and the lamp housing 13, with the long central axis of the threaded conduit being concentrically aligned with those of the shock mounting member 11 and the lamp housing 13.

Once the wires 16 have been connected to the electrical terminals 12T on its rear face 12R, the lamp unit 12 is then connected to the previously-joined shock mounting device 11 and the lamp housing 13 to provide the complete lamp assembly 10 by engaging the lamp unit aligning means that are conventionally provided on the rear of its circumferential bead 12B with the complementary seat means 11D and 11E which are provided on the first or rear portion of the circumferential flange 11C of the shock mounting device 11, while temporarily prying forward the plural finger-like grips 11G that are also provided on the second or front portion of said circumferential flange 11C. And, following the engagement of those conventional alignment means that are provided on the rear of the circumferential bead 12B of the lamp unit 12 with those complementary seat means 11D and 11E of the shock mounting device or member 11, the finger-like grips 11G are, of course, released to tightly engage the front face 12F of the lamp unit 12 and thus retain the same clamped between them and the complementary seat means 11D and 11E of the shock mounting device 11 wholly within the lamp housing 13 in a desired predetermined position and cantilevered from the domed end 13R of the lamp housing 13 through the plural serpentine segments 11S of the device 11.

It should be apparent that while there has been described what is presently considered to be a presently preferred form of the present invention in accordance with the Patent Statutes, changes may be made in the disclosed device without departing from the true spirit and scope of this invention. It is, therefore, intended that the appended claims shall cover such modifications and applications that may not depart from the true spirit and scope of the present invention.

What is claimed is:

1. A novel device for shock mounting a lamp within housing means for a lamp, comprising;

(a) a hollow generally frustoconical resilient member having a long central axis extending between centers of its opposite ends, with (b) one of said opposite ends of said member including means for retaining, supporting and locating a lamp in a predetermined position, and (c) the other of said opposite ends of said member including means for fastening said member to said lamp housing means, and (d) said member including plural segments positioned around said axis and extending between said opposite ends of said member, with (e) each of said segments being generally serpentine in its longitudinal extension with respect to said axis.

2. The invention of claim 1, wherein said means for retaining, supporting and locating comprise seat means formed on said member adjacent the intersection of one end of each of said segments with a portion of a circumferential flange that is formed on and extends around said one of said opposite ends of said member.

3. The invention of claim 2, wherein said means for fastening include plural apertures provided in said other of said opposite ends of said member.

4. The invention of claim 1, wherein said means for fastening include plural apertures provided in said other of said opposite ends of said member.

5. The invention of claim 1, wherein said member is constructed of a plastic material.

6. The invention of claim 5, wherein said material is nylon.

7. The invention of claim 6, wherein said nylon is DuPont's "Zytel" nylon.

8. The invention of claim 1, wherein said member is constructed of an elastomeric material.

* * * * *